United States Patent [19]

Osaka et al.

[11] 4,435,920

[45] Mar. 13, 1984

[54] SHUTTER CONSTRUCTION

[75] Inventors: Susumu Osaka; Minoru Toda, both of Machida, Japan

[73] Assignee: RCA Corporation, New York, N.Y.

[21] Appl. No.: 371,740

[22] Filed: Apr. 26, 1982

[51] Int. Cl.[3] ..... E05F 17/00; E06B 7/08

[52] U.S. Cl. ..... 49/82; 49/83; 49/403

[58] Field of Search ..... 49/82, 83, 74, 403; 98/121 A, 110

[56] References Cited

U.S. PATENT DOCUMENTS

| | | | |
|---|---|---|---|
| 395,902 | 1/1889 | Heidt | 49/74 |
| 2,610,371 | 9/1952 | Hite | 49/403 X |
| 3,130,458 | 10/1961 | Zacharias | 49/403 |
| 3,137,043 | 6/1964 | Moeller | 49/403 |
| 3,159,864 | 12/1964 | Ferrera | 16/1 |
| 3,460,289 | 8/1969 | Toth | 49/82 X |
| 3,928,937 | 12/1975 | Dovman | 49/403 |
| 4,195,444 | 4/1980 | Cote | 49/403 |

*Primary Examiner*—Philip C. Kannan

*Attorney, Agent, or Firm*—Joseph S. Tripoli; Robert L. Troike; William Squire

[57] ABSTRACT

A ribbed metal foil slat has a slat support bracket at each slat end, each bracket being driven by a corresponding four-bar linkage. The two four-bar linkages are driven concurrently in the same direction.

11 Claims, 10 Drawing Figures

SHUTTER CONSTRUCTION

The present invention relates to shutters.

A shutter comprises slats which are supported for rotation about parallel axes, and which may be driven by hand or by a motor. When made of relatively heavy gauge metal or other heavy material, a relatively large driving force is required to operate the slats. When the shutters are made of thinner materials to reduce the load on the drive mechanism, the strength of the slats decreases and this introduces problems. For example, shutters made of thin material such as 50 micron thick aluminum, tend to be relatively fragile and a torque applied at one end of a slat tends to result in twisting and distortion of the slat. The relatively thin slats may also include complex curves in the interest of light transmission efficiency which adds to the complexity of the structure and makes it more expensive.

A shutter construction in accordance with one embodiment of the present invention comprises a plurality of slats each slat having first and second opposite ends, two relatively long, parallel opposite edges, and a central axis parallel to and between these edges. A pair of support brackets are included for each slat, one bracket is secured to one end of each slat and the other bracket is secured to the opposite end of each slat, each bracket including two pivot means permitting rotation of the bracket about two spaced points, respectively, one point on one side of the central axis and the other point spaced from the one point.

First and second parallel support links are included with the first of the links adjacent to one end of the slats and the second of the links adjacent to the other end of the slats, the slats being perpendicular to the links and being spaced from one another along the length of links, each support bracket at one end of the slats being supported by the first link at one of its pivot means and each support bracket at the other end of the slats being supported by the second link at the corresponding one of its pivot means. The construction further comprises first and second support means, the first support means are adjacent to one end of the slats and the second support means are adjacent to the other end of the slats, each support bracket at one end of the slats being supported by the first support means at the other of its pivot means along a line parallel to the first link and each support bracket at the other end of the slats being supported by the second support means at the other of its pivot means along a line parallel to the second support link. Drive means concurrently drive the first and second support links in the same direction along the length dimension of the links relatively to the first and second support means for concurrently rotating the slats about axes parallel to their central axes.

Figure 1:
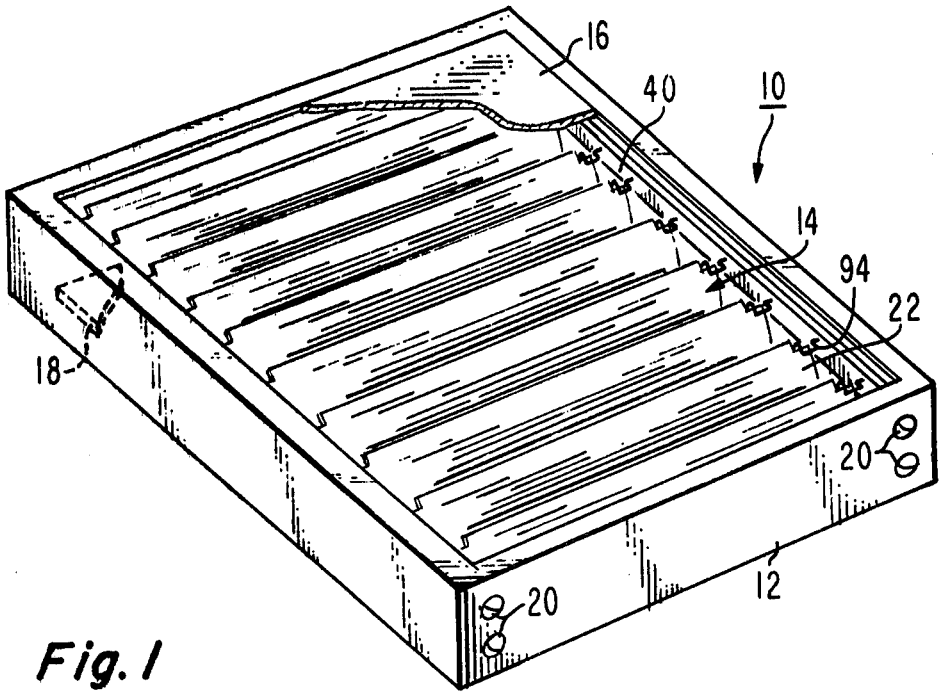
FIG. 1 is an isometric view of a shutter embodying the present invention.

In FIG. 1 shutter assembly 10 includes an outer frame 12 having a rectangular shape to which is secured an inner shutter mechanism 14. A pair of transparent covers 16 and 18 are secured to the frame 12 to enclose the shutter mechanism. The covers 16 and 18 may be thermoplastic, glass or any other transparent material. The shutter mechanism 14 is secured to the frame 12 by screws 20, only some of which are shown.

Figure 2:
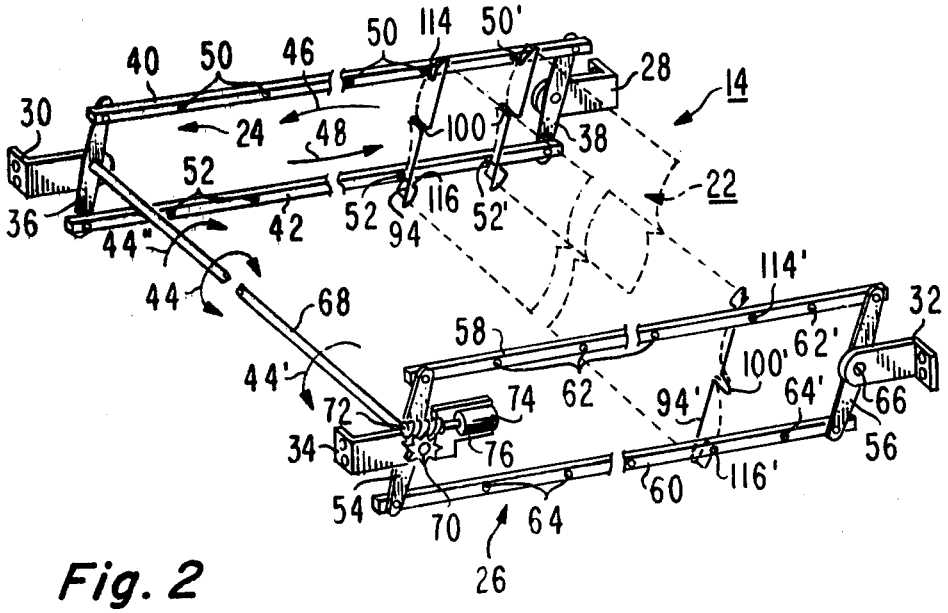
FIG. 2 is an isometric fragmented viaw of the construction of the operating portion of the shutter of FIG. 1.

In FIG. 2, the shutter mechanism 14 comprises a plurality of parallel slat assemblies 22, the slats of which are shown dashed (only two slats of the assembly being shown). Slat assemblies 22 are each secured to drive mechanisms 24 and 26. The drive mechanism 24 brackets 28 and 30 are secured to the frame 12 by the screws 20 as are the brackets 32 and 34 of the drive mechanism 26.

Drive mechanism 24 comprises a four-bar linkage formed with two rotating links 36 and 38 and two connecting links 40, 42. Opposite links may be identical. Link 40 is pivoted at one end to an end of link 36 and at its other end to an end of link 38. Link 42 is pivoted at one end to an end of link 38 and at the other end to an end of link 36. Rotation of the link 36 in one of the directions 44 rotates the other link 38 in the same direction and about a parallel axis. The rotation of links 36 and 38 displaces the links 40 and 42 in equal but opposite directions in a known way. Link 36 is pivotally secured to the bracket 30 and the link 38 is pivotally secured to the bracket 28. By way of example, the rotation of link 36 in the counterclockwise direction 44' moves the link 40 in an arcuate direction 46 and the link 42 in an arcuate direction 48, equal and opposite to the direction 46, since links 40, 42 are spaced equally from the pivot axes through links 36, 38.

A plurality of equally spaced bearing apertures 50 are formed in the link 40. A plurality of like equally spaced apertures 52 are formed in link 42. The spacing of the apertures 50, 52 in their respective links 40, 42 is such that the apertures 50 are each aligned with respect to the apertures 52 in a direction parallel to the links 36 and 38. For example, aperture 50' in link 40 is aligned with respect to aperture 52' in link 42 such that a line passing through those apertures is parallel to a line passing through the end pivots of the links 36 and 38. Rotation of the links 36 and 38 in directions 44 about their respective axes of rotation, rotates the aligned apertures, for example, apertures 50', 52' about an axis of rotation parallel to the axes of rotation of the links 36, 38. Similarly, the remaining aligned aperture pairs of apertures 50, 52 also rotate about parallel axes.

The drive mechanism 26 is constructed similarly as the mechanism 24. Rotating links 54 and 56 correspond, respectively, to and have identically spaced pivots as links 36 and 38. Elongated links 58 and 60 correspond, respectively, to and have identically spaced pivots as links 40 and 42. The links 40, 42, 58, and 60 are parallel.

Bearing apertures 62 in link 58 are aligned with respect to apertures 64 in link 60 in a manner similar to the apertures 50, 52 in links 40 and 42. In addition, a pair of aligned apertures in the mechanism 26, for example, apertures 62' and 64' form an aperture set with a pair of aligned apertures 50' and 52' of the mechanism 24. The purpose of this four aperture set is to support a slat in a manner to be described. Link 56 rotates about a pivot pin 66 in bracket 32 and the link 54 rotates about a pin in bracket 34. Links 38 and 36 rotate about pivot pins in brackets 28 and 30, respectively.

Drive rod 68 connects link 54 to the link 36. Rotation of drive rod 68 rotates the links 36 and 54. Rotation of the link 54 rotates the link 56 via links 58 and 60. Gear 70 is fixed to the drive rod 68. A mating worm gear 72 driven by motor 74 is engaged with and drives gear 70. Motor 74 is attached to a bracket 76 which is connected to bracket 34. Motor 74 may be battery operated or powered from a source of power (not shown) and operated in a known way. Rotation of the worm gear 72 rotates the gear 70 which rotates the rod 68. Rotation of the rod 68 rotates the links 36, 38, 54, and 56 as described, the brackets 28, 30, 32, and 34 being held stationary by screws 20, FIG. 1.

Figure 4:
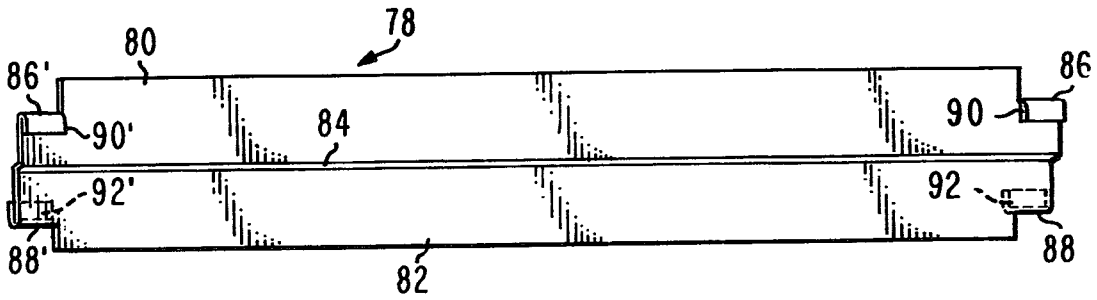
FIG. 4 is a side elevation view of a shutter slat employed in the embodiment of FIG. 1.
Figure 3:
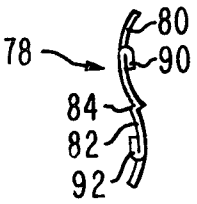
FIG. 3 is an end elevation view of the shutter of FIG. 1.
Figure 5:
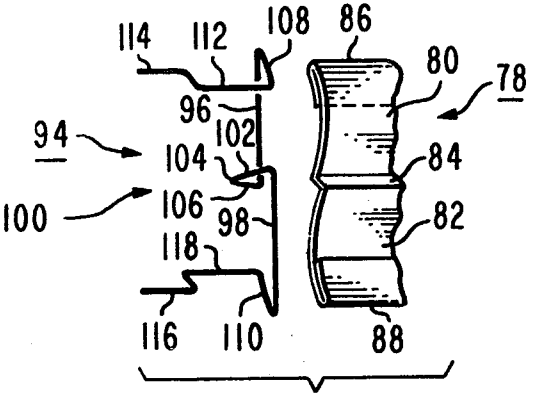
FIG. 5 illustrates a bracket during assembly to an end of a slat.

As shown in FIG. 4, slat 78 may be formed of thin material, for example 50 micrometer thick foil, which may be aluminum or any other metal. The slat is formed with an arcuate first portion 80 (this curve and curve 82 are visible in FIGS. 3, 5, and 6) which extends the length of the slat and an arcuate second portion 82 which also extends the length of the slat. The combined structure appears in end view as a modified S, FIG. 3. The portions 80 and 82 are joined by a rib 84 which is a bend in the sheet material extending the length of the slat from end to end. The bend 84, as seen in FIG. 5, comprises a straight leg which connects portion 80 to portion 82 so that the two portions are displaced a small distance. The end of the slat, FIG. 4, are formed with shoulders 86, 86' and 88, 88' by cutting portions of the material and folding it over as at 90, 90' and 92, 92'. The folded over portions may then be compressed against the remaining body of the slat to form a double thickness at that location. This fold over reinforces the slat material at the shoulders 86 and 88.

Figure 8:
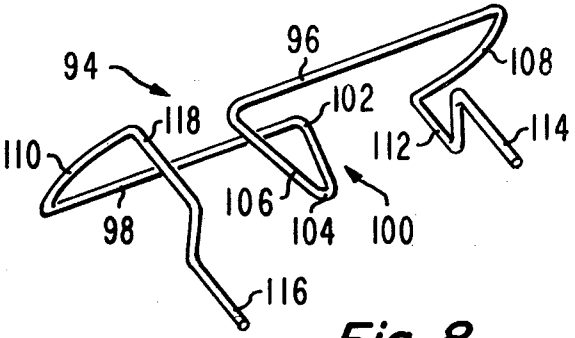
FIG. 8 is an isometric view of a wire formed bracket employed in the embodiment of the present invention.

Bracket 94, FIG. 8, is secured to the slat at each end over the shoulders 86 and 88. The bracket 94 in one embodiment may be formed of a wire of relatively stiff material, such as piano wire, but which is readily deformed to the shape shown. The wire has two straight portions 96 and 98 which are connected by a loop portion 100. The loop portion 100 has a leg 102, a bend 104, and a second leg 106. The leg 102 is connected to the straight portion 98 and the leg 106 to the straight portion 96. The end of the straight portion 96 is bent into a curved shape as shown at 108, and the leg 98 is bent into a similar curved shape at 110. The shapes of the bends at 108 and 110 closely follow the contour of the curves of the slat portions at 80 and 82, FIG. 5. The wire at 108 is then bent into a straight leg 112 which is generally normal to the straight portion 96, and then formed into a straight pivot pin 114 parallel but offset from leg 112. A second pivot pin 116 is formed from and extends from the wire at 110 in a similar construction, but in this case extends from straight portion 118 and is offset in a direction opposite to the offset of the pin 114. The reason for the offset of pins 114 and 118 will be as explained.

Figure 6:
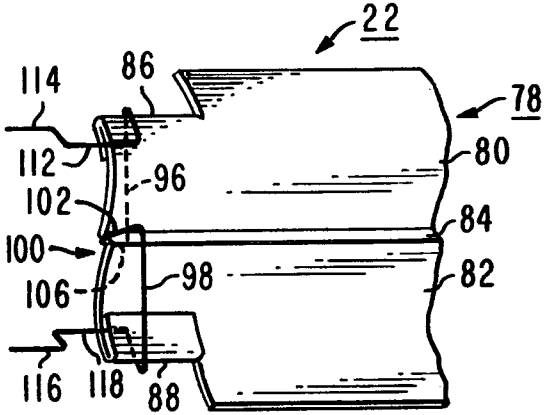
FIG. 6 shows the bracket of FIG. 5 after assembly to a slat.

FIG. 5 illustrates the bracket 94, in position at one end of the slat 78. Bracket 94' shown in FIG. 2, is the mirror image of bracket 94 and it is positioned at the opposite end of the slat 78. As shown in FIG. 5, the bracket straight portion 96 is aligned with the slat portion 80 and the bracket straight portion 98 is aligned with the slat portion 82. The loop 100 is aligned with the rib 84. Leg 102 slips over the end of the slat on one side of the rib 84 and the leg 106 of the loop slips over the other side of the rib 84 as shown in FIG. 6. The straight portion 96 is over the concave portion of portion 80 and the straight portion 98 is over the concave portion 82 of the slat 78, FIG. 6. The curved portion 108 of the bracket is over the convex side of portion 80 and the curved portion 110 of the bracket is over the convex side of portion 82, FIG. 6. A straight line such as broken line 97, FIG. 7, through the pins 114, 116 passes through the mass center of the slat. The offset of the pins 114, 116 achieves the mass center balancing of the slat portions with respect to that line through the two pins.

A slat 78 may be assembled to a bracket 94 by compressing the slat edges toward the rib 84 to slip the shoulders 86 and 88 between the bends formed by portions 98, 110 at one end and 96, 108 at the other end of the bracket. The bracket being formed of a wire is relatively lightweight and provides stiffness to the slat at the slat end to both hold and transmit a drive force to the slat.

The pin 114 of the bracket 94, FIG. 2, is assembled to aperture 50 and the pin 116 to aperture 52 of the respective links 40, 42. The corresponding pins 114', 116' of bracket 94' are respectively assembled to aperture 62 of link 58 and aperture 64 of link 60. In similar fashion, the remaining slat assemblies are secured to the links 40, 42, 58, and 60 so that all of the slats are parallel. These slats are also normal to links 40, 42, 58, and 60.

Figure 9:
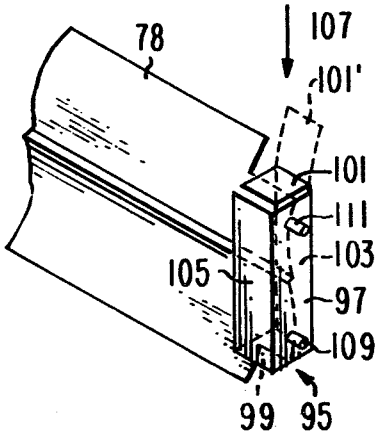
FIG. 9 is an isometric view of a bracket which may be used in the alternative to the bracket of FIGS. 5 and 6.

A box-like end receptacle 95, FIG. 9, for each end of a slat 78 may be employed in the alternative to a bracket such as bracket 94. In this case, the end receptacle 95 may be formed of sheet metal. In FIG. 9, receptacle 95 includes a base wall 97, two end walls 99, 101, and two opposite side walls 103, 105. The end wall 101 may be foldable from a position shown dashed at 101' to permit the slat to slide into the cavity of the box in direction 107. The receptacle 95 may be pivotally secured by pivot pins 109, 111 to the same structure as bracket 94, pins 114, 116.

In operation, the motor 74, FIG. 2, is energized, rotating the worm gear 72 rotating the drive rod 68 via gear 70. This rotates the links 54 and 36 in one of directions 44. In turn, the links 40, 42, and 58 and 60 are caused to move in the corresponding directions and this, in turn, moves the other links 38 and 56. The assembly comprising links 40, 42, 36, and 38 in one set and links 54, 56, 58, and 60 in a second set thus form two four-bar linkages. The connection of the brackets 94, 94' to the four-bar linkages at the respective pins and bearing apertures causes the slat assemblies 22 to each rotate about axes parallel to the axis of rotation of the rod 68 and parallel to directions 44. The slats can therefore be rotated 180° from a full closed position to a full open position to a full closed position in the opposite direction. By driving both ends of the slat at brackets 94 and 94', FIG. 2, the twisting problem of driving relatively thin flexible sheet material is alleviated. The thin wire brackets and the lightweight slat material form a relatively lightweight assembly 22. The brackets of the embodiment of FIG. 9, which may be made of sheet metal, also are relatively light in weight. Links 40, 42 may be lightweight rod material. As a result, the drive force required to rotate rod 68 is relatively small.

Figure 7:
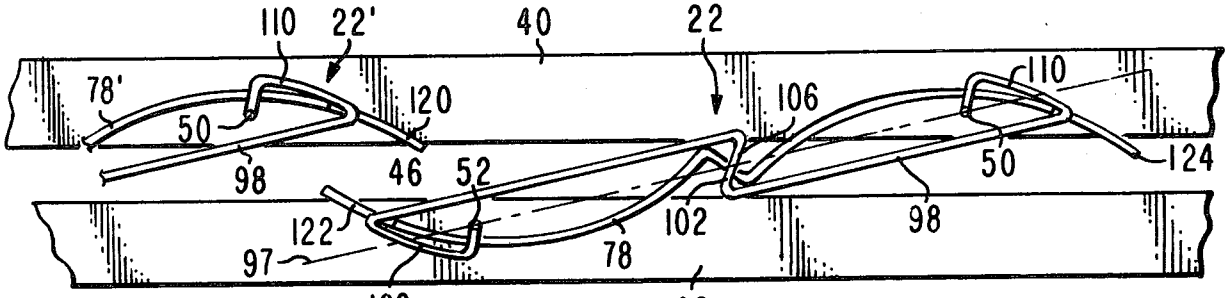
FIG. 7 is an end elevation view showing the spaced relationship of adjacent slats during one orientation of the slats.

In FIG. 7, the slats are shown almost fully closed. In this case the drive rod 68, FIG. 2, has been rotated in direction 44''. The dashed line 97 passing through slat 78 of assembly 22 is parallel to a corresponding line (not shown) passing through the slat 78' of assembly 22', FIG. 7. A portion 120 of the slat 78' overlaps a portion 22 of the slat 78. In this case the links 40 and 42 are close to one another. In the fully closed position, the links 40, 42 abut and the slats 78 and 78' may be placed even closer at the portions 120 and 122 than that shown. By rotating the rod 68, FIG. 2, in direction 44', the slat assemblies 22, FIG. 7, are rotated in the counterclockwise direction so that the portions 120 and 122, which were overlapping, are apart and the slats open.

While one type of four-bar linkage has been shown in the above embodiment to illustrate the driving mechanism for operating the slats, other four-bar linkage drive mechanisms may be employed instead. For example, one link 42 and 60 may be omitted from each four-bar linkage assembly and the brackets 30, 28 formed into a first stationary single long link and the brackets 34, 32 formed into a second stationary single long link such as link 130, FIG. 10.

Figure 10:
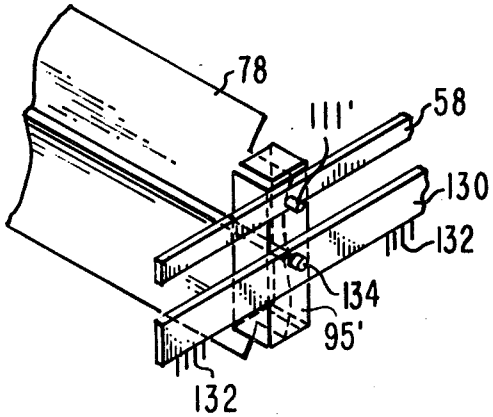
FIG. 10 is an isometric fragmented view of a linkage which is an alternative to the construction of FIG. 2.

In FIG. 10, the stationary link 130 is secured to frame 12, FIG. 1, similarly as brackets 28–34, FIG. 2, which brackets are represented by symbols 132, in FIG. 10. Box-like bracket 95' similar in shape to bracket 95, FIG. 9, receives an end of slat 78. Bracket 95' is pivotally secured to link 58 by pin 111'. Bracket 95' is pivotally secured to link 130 by pin 134 which forms the axis about which slat 78 rotates. A similar construction is at the other end of the slat 78. Pin 134 may be located on the central axis of slat 78.

In the alternative the bends 100 of the slat brackets 94, 94', FIG. 2, may be formed into a shaft similar to pins 114, 116, FIG. 8, as a substitute for pin 134, FIG. 10. The shafts so formed are central on the slat brackets and may then be inserted in bearing apertures in the links formed from the extension of brackets 32, 34, or 28 and 30 such as link 130, FIG. 10. These latter links remain stationary and fixed in place, forming a four-bar linkage in which one bar is stationary. Rotation of the links 36 and 54 and the connecting links 40 and 58, FIGS. 2 and 10, would be sufficient to rotate the brackets 94, 94' with respect to the shafts corresponding to pins 134, FIG. 10, at the bends 100, which are in the stationary link, rotating the slats in similar fashion to that described above with respect to the embodiment of FIG. 2. An important feature is that both ends of each slat are driven directly by the drive mechanism and are not driven by means of a torque created through the slat structure itself. This tends to avoid the twisting torques which tend to produce a lag in very thin slat material. The transparent covers 16, 18, FIG. 1, protect the structure from environmental damage. The entire structure forms a portable cassette shutter construction which is easily installed in many different implementations. The brackets 94, 94' restrain the slats in any orientation of the assembly permitting wide latitude in the installation and handling of the assembly, from a horizontal to vertical orientation.

What is claimed is:

1. A shutter construction comprising:

a plurality of slats, each slat having first and second opposite ends, two relatively long, parallel opposite edges, and a central axis parallel to and between these edges;

a pair of support brackets for each slat, one bracket secured to one end of each slat and the other bracket secured to the opposite end of each slat, each bracket including two pivot means permitting rotation of the bracket about two spaced points, respectively, one point on one side of the central axis and the other point spaced from the one point on the other side of the central axis;

first and second parallel support links, the first of said links adjacent to one end of the slats and the second of said links adjacent to the other end of the slats, the slats being perpendicular to said links and being spaced from one another along the length of links, each support bracket at one end of the slats being supported by said first link at one end of its pivot means and each support bracket at the other end of the slats being supported by said second link at the corresponding one of its pivot means;

first and second support means, said first support means adjacent to one end of the slats and said second support means adjacent to the other end of the slats, each support bracket at one end of the slats being supported by said first support means at the other of its pivot means along a line parallel to said first link and each support bracket at the other end of the slats being supported by said second support means at the other of its pivot means along a line parallel to said second support link; and drive means for concurrently driving said first and second support links in the same direction along the length dimension of said links relative to said first and second support means for concurrently rotating the slats about axes parallel to their central axes.

2. The construction of claim 1 wherein said drive means comprises two rotatable drive links one coupled between one end of the first support link and a corresponding end of the first support means, and the other drive link coupled between the same end of the second support link and the corresponding end of the second support means, and means for concurrently rotating said drive links in the same direction.

3. The construction of claim 2 wherein said first and second support means comprise third and fourth support links of substantially the same construction as said first and second support links, all four support links being movable, whereby rotation of said two rotatable drive links drives the first and second support links in one direction and the third and fourth support links in the opposite mirror image direction.

4. The construction of claim 1 wherein each bracket comprises a wire element which is shaped to fit over and hold securely the end of a slat and the free ends of which, when the bracket is in place on a slat, extend away from the slat and parallel to its central axis, said free ends serving as the two pivot means.

5. A shutter construction comprising:

a plurality of parallel slats each having opposite ends, two relatively long, parallel opposite edges, and a central axis parallel to and between these edges;

first and second stationary support means;

a plurality of brackets, one at each slat end;

two sets of four-bar linkages, each set comprising two pairs of parallel links, each link of at least one pair being pivotally secured to the corresponding link of the other pair;

means for pivotally securing one link of the one pair of each set to said first stationary support means for rotation about a first stationary pivot axis;

means for pivotally securing the other link of the one pair of each set to said second stationary support means for rotation about a second stationary pivot axis spaced from and parallel to the first axis;

means for synchronously rotating said one and other links about said first and second axis, respectively; and means for pivotally securing each said brackets at each slat end to each link of the other link pairs of the four bar linkage at two spaced pivot points at each slat end, one point on one side of the central axis of that slat and the other point on the other side of the central axis of that salt.

6. The construction of claim 5 wherein said slats each comprise a ribbed foil element which bends and twists when torqued at one end with respect to the other end, said brackets comprising a preformed wire shaped to receive an end of said slat therein including a loop for receiving a foil element rib.

7. The construction of claim 5 wherein each slat has first and second arcuate parallel portions connected by a rib element extending along the length of the slat, the convex side of one portion facing the same direction as the concave side of the other portion, said bracket comprising a wire element having first and second mirror image segments connected by a central loop segment, said mirror image segments each including a member which is adapted to bridge the concave portion of said salt, said central loop segment receiving said rib element.

8. In a shutter construction including a plurality of rotatably mounted salts, each slat rotating about an axis, said slat axes being parallel and link means for rotating said slats about their respective axes, the combination therewith comprising a bracket at each slat end for pivotally connecting that slat to said link means, each said bracket comprising a pair of pivot means, one pivot means of each pair being offset from the slat axis of rotation on one side of said axis and the other pivot means being offset from said slat axis on the opposite side of said axis, said link means comprising two four-bar linkages one at each slat end and in which each linkage comprises two links, each link rotatable about a respective stationary axis parallel to said slat axes, a third link rotatably coupled to one of said pivot means at a slat end and a fourth link rotatably coupled to the other of said pivot means at said slat end.

9. The construction of claim 8 wherein said bracket comprises a wire member having a central bend for receiving the slat end therein and a pair of bends, one at each end of the bracket for securing the bracket to the slat, said shafts extending from the respective bracket ends.

10. A shutter construction comprising:

a plurality of slats, each slat having first and second opposite ends, two relatively long, parallel opposite edges, and a central axis parallel to and between these edges;

a pair of support brackets for each slat, one bracket secured to one end of each slat and the other bracket secured to the opposite end of each slat, each bracket including two pivot means permitting rotation of the bracket about two spaced points, respectively, one point on one side of the central axis and the other point spaced from the one point;

first and second parallel support links, the first of said links adjacent to one end of the slats and the second of said links adjacent to the other end of the slats, the slats being perpendicular to said links and being spaced from one another along the length of links, each support bracket at one end of the slats being supported by said first link at one end of its pivot means and each support bracket at the other end of the slats being supported by said second link at the corresponding one of its pivot means;

first and second support means, said first support means adjacent to one end of the slats and said second support means adjacent to the other end of the slats, each support bracket at one end of the slats being supported by said first support means at the other of its pivot means along a line parallel to said first link and each support bracket at the other end of the slats being supported by said second support means at the other of its pivot means along a line parallel to said second support link; and drive means for concurrently driving said first and second support links in the same direction along the length dimension of said links relative to said first and second support means for concurrently rotating the slats about axes parallel to their central axes;

said drive means comprising two rotatable drive links, one coupled between one end of the first support link and a corresponding end of the first support means, and the other drive link coupled between the same end of The second support link and the corresponding end of the second support means, and means for concurrently rotating said drive links in the same direction; and said first and second support means comprising third and fourth support links of substantially the same construction as said first and second support links, all four support links being movable, whereby rotation of said two rotatable drive links drives the first and second support links in one direction and the third and fourth support links in the opposite mirror image direction.

11. A shutter construction comprising:

a plurality of slats, each slat having first and second opposite ends, two relatively long, parallel opposite spaced edges, and a central axis parallel to and between these edges;

a pair of support brackets for each slat, one bracket secured to one end of each slat and the other bracket secured to the opposite end of each slat, each bracket including two pivot means permitting rotation of the bracket about two spaced points, respectively, one point on one side of the central axis and the other point spaced from the one point, each bracket comprising a wire element which is shaped to fit over and hold securely the end of a slat and the free ends of which, when the bracket is in place on a slat, extend away from the slat and parallel to its central axis, said free ends serving as the two pivot means;

first and second parallel support links, the first of said links adjacent to one end of the slats and the second of said links adjacent to the other end of the slats, the slats being perpendicular to said links and being spaced from one another along the length of links, each support bracket at one end of the slats being supported by said first link at one end of its pivot means and each support bracket at the other end of the slats being supported by said second link at the corresponding one of its pivot means;

first and second support means, said first support means adjacent to one end of the slats and said second support means adjacent to the other end of the slats, each support bracket at one end of the slats being supported by said first support means at the other of its pivot means along a line parallel to said first link and each support bracket at the other end of the slats being supported by said second support means at the other of its pivot means along a line parallel to said second support link; and drive means for concurrently driving said first and second support links in the same direction along the length dimension of said links relative to said first and second support means for concurrently rotating the slats about axes parallel to their central axes.

* * * * *